US011311813B2

(12) United States Patent
Cüppers

(10) Patent No.: US 11,311,813 B2
(45) Date of Patent: Apr. 26, 2022

(54) ROLLERCOASTER TRIGGER SYSTEM

(71) Applicant: VEKOMA RIDES ENGINEERING B.V., Vlodrop (NL)

(72) Inventor: Hendrik Jozef Christina Cüppers, Vlodrop (NL)

(73) Assignee: VEKOMA RIDES ENGINEERING B.V., Vlodrop (NL)

( * ) Notice: Subject to any disclaimer, the term of this patent is extended or adjusted under 35 U.S.C. 154(b) by 0 days.

(21) Appl. No.: 17/436,268

(22) PCT Filed: Mar. 5, 2020

(86) PCT No.: PCT/NL2020/050142
§ 371 (c)(1),
(2) Date: Sep. 3, 2021

(87) PCT Pub. No.: WO2020/180182
PCT Pub. Date: Sep. 10, 2020

(65) Prior Publication Data

US 2022/0040587 A1 Feb. 10, 2022

(30) Foreign Application Priority Data

Mar. 6, 2019 (NL) ..... 2022683

(51) Int. Cl.
*A63G 7/00* (2006.01)
*B61L 3/06* (2006.01)
*A63G 21/08* (2006.01)

(52) U.S. Cl.
CPC ..... *A63G 7/00* (2013.01); *A63G 21/08* (2013.01); *B61L 3/065* (2013.01)

(58) Field of Classification Search
CPC ..... A63G 7/00; A63G 21/00; A63G 21/04; A63G 21/08; B61L 3/065
See application file for complete search history.

(56) References Cited

U.S. PATENT DOCUMENTS 5,527,221 A * 6/1996 Brown ..... A63G 21/08 104/78
5,595,121 A * 1/1997 Elliott ..... B61B 13/00 104/53

(Continued)

FOREIGN PATENT DOCUMENTS

EP 3 388 120 A1 10/2018

OTHER PUBLICATIONS

Dutch Search Report and Written Opinion, issued in Priority Application No. 2022683 dated Nov. 7, 2019.

(Continued)

*Primary Examiner* — Robert J McCarry, Jr.
(74) *Attorney, Agent, or Firm* — Birch, Stewart, Kolasch & Birch, LLP

(57) ABSTRACT

In a rollercoaster trigger system to output a data signal to a control unit for triggering and controlling an event at a predetermined track position, a beacon plate with a certain aperture pattern and a sensor set is provided to send a trigger signal and a data signal to the control unit. The sensor set includes a first and a second trigger sensor which provide together the trigger signal to readout the data of the beacon plate when together simultaneously detecting a first and second trigger aperture of the aperture pattern. A read sensor is provided for reading data from the aperture pattern by detecting a presence or absence of a read aperture. The data signal is obtained by the control unit when the trigger signal is generated.

20 Claims, 4 Drawing Sheets

(56) References Cited

U.S. PATENT DOCUMENTS

| | | | | |
|---|---|---|---|---|
| 5,623,878 | A | 4/1997 | Baxter et al. | |
| 5,791,254 | A | 8/1998 | Mares et al. | |
| 6,122,571 | A * | 9/2000 | Gerstner | A63G 1/10 104/53 |
| 6,871,596 | B2 * | 3/2005 | De-Gol | A63G 1/34 104/53 |
| 2006/0085107 | A1 | 4/2006 | Hoffmann et al. | |

OTHER PUBLICATIONS

International Search Report, issued to PCT/NL2020/050142, dated Jul. 9, 2020.
Written Opinion of the International Searching Authority, issued to PCT/NL2020/050142, dated Jul. 9, 2020.

* cited by examiner

| DATA SIGNAL | | | | |
|---|---|---|---|---|
| XS2 (LSB) | XS3 | XS4 | XS5 (LSB) | Value |
| 0 | 0 | 0 | 0 | *0* |
| 0 | 0 | 0 | 1 | *1* |
| 0 | 0 | 1 | 0 | *2* |
| 0 | 0 | 1 | 1 | *3* |
| 0 | 1 | 0 | 0 | *4* |
| 0 | 1 | 0 | 1 | *5* |
| 0 | 1 | 1 | 0 | *6* |
| 0 | 1 | 1 | 1 | *7* |
| 1 | 0 | 0 | 0 | *8* |
| 1 | 0 | 0 | 1 | *9* |
| 1 | 0 | 1 | 0 | *10* |
| 1 | 0 | 1 | 1 | *11* |
| 1 | 1 | 0 | 0 | *12* |
| 1 | 1 | 0 | 1 | *13* |
| 1 | 1 | 1 | 0 | *14* |
| 1 | 1 | 1 | 1 | *15* |
| | | | | |

ROLLERCOASTER TRIGGER SYSTEM

The present invention relates to a rollercoaster, a trigger system and a method for controlling an event at a rollercoaster.

US2006/0085107 discloses an amusement ride which has a route subdivided into sections. Vehicles are driven exclusively by gravity along the route. Switching elements are arranged on the route for switches situated on the vehicle in order to determine the position of the vehicle on the route. Vehicle controllers on the vehicles are connected to a central controller via a radio network.

The switching elements are assigned switches with sensors on the vehicles. If the vehicle moves past the switching element, the switch identifies a section change and reports this to the central controller away of the vehicle controller that is disposed on board.

The switching element uses a group of transmitters which not only reveal a section change of a vehicle but at the same time also supply a specific item of information regarding which section change is currently being crossed. In an illustrated embodiment of FIG. 3, the switching element has four possible positions for transmitters. As illustrated in FIG. 7-9, an elongated metal plate can be mounted to each position. The metal plate is magnetised or may have a light-reflecting surface to serve as a transmitter. An occupation of such a position enables a precise identification of the switching element. Two positions on the switching elements are intended for transmitters which are arranged to perform a so-called 'trigger function' in order to enable an exact check of the occupation of the other transmitter position. These two positions are always occupied by transmitters.

A switching element is in the direction of travel subdivided into two groups of transmitters. If the vehicle moves past the switching element in the travel direction, a first triggering signal is provided when the vehicle is in the first group of transmitters. Subsequently, a second triggering signal is provided when the vehicle is in the second group of transmitters. Each triggering signal is a signal for the controller to a certain with the aid of other sensors whether or not the other positions are occupied by transmitters. This type of arrangement or occupation of position for the transmitters force very high safety since 'read errors' cannot occur if the vehicles move past switching element at relatively high speed.

A drawback of the disclosed switching element is that the metal plates forming the transmitters require a relatively large mounting space. A metal plate is oblong and mounted in parallel with another metal plate by brackets to the track. This side by side arrangement of plates and the mounting of brackets for holding the plates requires a large build-in space at the track. A binary signal is provided by an absence or presence of each metal plate. Several plates together may provide a combined signal to the vehicle controller. It is a disadvantage of the switching element, that due to a limited mounting space at the track and the spatial arrangement of the metal plates a data transfer is limited.

From U.S. Pat. No. 5,791,254 a roller coaster is known. The roller coaster has a track which has a configuration which allows a train of coupled cars to travel in any direction. Each car has a frame for supporting a seat for seating at least one passenger. The frame is attached to a carriage by an axle which allows a full rotation of the frame with respect to the carriage. The carriage has set of wheels for disposing the carriage on a rail of the track.

The roller coaster has a passenger control system for selectively allowing or preventing a free rotation of the frame about the axle. With reference to a FIG. 6, it is disclosed that programmed instructions are issued by an on-board computer within a drive controller and servo or open-loop drive system as a function of drive location. A car location along the track is maintained by the control system by communicating with position transmitters or antennas placed at intervals along a length of the track. The control system allows for variations in the ride experience. In such a way, a pitch position of the seat can be controlled.

In further detail, it is disclosed that the pitch rotation is preferably controlled by commands stored within interchangeable preprogrammed memory modules. Variations of the ride experience as to the degree of seat position and pitch axis angular rate can be selected as determined suitable by the ride operator. In operation of the control system, the pitch seat position begins in an initial position permitting passenger boarding. The operator selects the type of ride, which loads the preprogrammed instructions from the memory module into the control memory.

When the ride is released, the track position transmitters/antennas are activated. The translation of the car causes a control receiver within the drive controller to pass a track position transmitter/antenna. The control system commands a seat drive motor to rotate the seat to a preprogrammed angular position at a preprogrammed angular rate. The control system commands the seat drive motor along the track according to the car location as indicated by the position transmitters/antennas.

In further detail, it is disclosed that a signal is received from a track-mounted position transmitter/antenna. The position transmitter/antenna is coded as to its specific location on the track. The control system derives the seat angular position and angular rate of motion from the preprogrammed memory instruction based on the cars specific track location. The control system commands the seat drive motor to rotate to a specific angular position and at the specific angular rate. The angular position and rate is followed by the motor mounted position sensor. The control system rotates the seat to the specific angular position and at the specific angular rate at each successive track-mounted position transmitter/antenna. Loss of a track-mounted position transmitter/antenna signal, or the receipt of a non-valid signal, preferably causes a coupling clutch to disengage.

U.S. Pat. No. 5,595,121 in the name of Walt Disney Company discloses an amusement ride having a track and a self-propelled electric powered ride vehicle. The vehicle includes an on-board vehicle controller and peripheral equipment for controlling the vehicle. In a conventional manner, an electric bus bar mounted along the track is used to provide electric power to the on-board propulsion and controller. A master controller is provided for communicating with and coordinating a movement of ride vehicles.

It is disclosed that the on-board vehicle controller is preferably provided for communication with and controlling motor controllers for precision control over the speed and direction of the vehicle travel. The on-board vehicle controller can be used to determine the position of the vehicle on the track when appropriate sensing or location pickup devices are provided.

Each vehicle is preferably provided with two passenger cars, each of which is attached to a passenger platform. The passenger cars are preferably capable of holding at least about four adult passengers in each car. Individual seats can be provided for each passenger. The seat can be mounted on a seat pivot point and made selectively positionable during travel so that the orientation or tilt of a seat relative can be adjusted to a frame of the vehicle. The on-board vehicle controller could dynamically set an orientation or tilt of the seat throughout the ride to enhance or minimise G-forces experienced by the passenger.

U.S. Pat. No. 5,527,221 discloses an amusement ride car system with multiple axis rotation. Each car has a seat portion which is attached to a dolly through an articulating structure providing rotation about a vertical axis and a horizontal axis. Each car has a self-contained controller. The controller incorporates a digital input card to receive external control input. Sensors incorporated on the car provide position information on the track for processing by the CPU to obtain appropriate controller response. Programming of the controller for various outputs based on input from the sensors are time intervals calculated by the CPU, establishes coordination of the rotation and tilt of the seat portion of the car. Proximity sensors attached to the dolly are activated by metal targets embedded in the track at desired locations.

An embodiment is disclosed in which three rotate program start sensors are employed to provide three bits of digital information. The three sensors are connected to a digital input card providing information for the rotate program start input. Seven positions or operational sequences can be identified by the embedded activators in the track. The distinct position inputs may be employed to identify home position requirements for high accuracy positioning of the seat portion of the car to eliminate hysteresis or other inaccuracy created in the car position due to the inherent accuracy of the drive motor control system.

EP3,388,120 discloses a rollercoaster comprising a controller operable to operate a compartment positioning mechanism to provide a movement of the passenger compartment, a yaw movement, based on a sensed motion trigger positioned along the track.

All these known amusement devices provide a passenger vehicle ride along a track in which the passenger vehicle has a passenger seat which is driveable in rotation with respect to a chassis. The passenger seat is rotatable at a certain track position by a trigger system. A track mounted trigger is provided at said track position to start the rotation of the passenger seat when the passenger vehicle passes trigger. The passenger vehicle has an on-board control unit which is electronically connected to a drive motor for rotating the passenger seat. The control unit is connected to at least one sensor or receiver which provide an input to the control unit to start the rotation of the passenger seat.

A problem to these known trigger systems of these amusement devices is that these trigger systems act too slow. The trigger systems require a start-up time and a processing time which is too long when considering a modern rollercoaster. Many known trigger systems include a bus system and a converter which often provide a high start-up and processing time. Nowadays rollercoasters run at high speeds which require a fast trigger system. A negligible start-up and processing time is desired.

The general object of the present invention is to at least partially eliminate the above mentioned drawbacks and/or to provide a usable alternative. More specific, it is an object of the invention to provide a rollercoaster with a trigger system requiring a minimum of build-in space, providing a fast response time for a large data transfer and a method of operating such a rollercoaster.

According to the invention, this object is achieved by a rollercoaster according to claim 1.

The rollercoaster according to the invention comprises a track with a rail to provide a rollercoaster ride path. The rollercoaster comprises at least one passenger vehicle, in particular a train of passenger vehicles, which is mounted to the rail to travel the passenger vehicle along the track. The passenger vehicle comprises at least one passenger seat which is mounted to a chassis of the passenger vehicle.

The rollercoaster further comprises a trigger system at a certain track position to instruct a control unit for an event. The trigger system is adapted to output a data signal to the control unit to carry out the event. The trigger system has a beacon which cooperates with at least one sensor. The bacon and the at least one sensor are cooperating components to provide the data signal to the control unit. The beacon is configured to be detected by the at least one sensor. When detecting the beacon, the at least one sensor sends a sensor signal to the control unit to carry out the event. In other words, when the at least one sensor meets the beacon at the predetermined track position, the data signal is sent to the control unit to carry out the event.

One of the cooperating components is positioned at the predetermined track position to provide the data signal when the passenger vehicle arrives at that track position. The at least one sensor may be mounted to the track and the beacon may be mounted to the vehicle or vice versa. Herewith, the output of the data signal is dependent of the predetermined track position. The beacon or the at least one sensor is mounted to the track which is advantageous to provide an accurate timing of the event at the moment that the passenger vehicle arrives at the predetermined track position. This accuracy of the timing of the event may be less dependent of a vehicle speed.

The beacon according to the invention is formed by a beacon plate. The beacon plate includes an aperture pattern of a set, in particular an array, of selective open or closed read apertures. The aperture pattern of the beacon plate determines a predetermined data. The rollercoaster may comprise a plurality of beacons which may each include distinguishing data formed by a distinguishing aperture pattern. The predetermined data of the beacon, also called coded data, may be specifically related to the predetermined track location or a specific vehicle.

The aperture pattern is to be read by the at least one sensor. The at least one sensor is configured to read whether or not an aperture is present, i.e. open or closed. Preferably, the sensor is a binary sensor for providing one of two possible data signals, i.e. a high and low signal. When reading an open aperture, a presence of an aperture, the sensor may provide the high signal, while an absence of an aperture, a closed aperture, may be indicated by the low signal of the sensor. Herewith, at least two distinct data signals can be provided by one sensor. A use of more than one sensor allow a variety of data signals which are formed by different combinations of sensor signals. More than one sensor can be used to provide a specific data signal out of a plurality of possible data signals as an output to the control unit.

According to the invention, the at least one sensor of the trigger system is part of a sensor set. The sensor set has sensors which are disposed in correspondence with the aperture pattern of the beacon plate which is to be read. In particular, the sensors are spaced in correspondence with a centre distance in between each aperture of the aperture pattern.

The sensor set comprises a first and second trigger sensor and at least one read sensor. The first and second trigger sensor are configured to trigger a moment for reading the aperture pattern. Seen in the travel direction, the first and second trigger sensor are positioned behind each other.

During a travel, the first and second trigger sensor will successively detect a beacon. The first and second trigger sensor are configured to provide together a trigger signal to readout the data of the beacon plate.

The trigger signal is formed by the first and second sensor signal of the first and second trigger sensor. The aperture pattern of the beacon plate includes a first and second trigger aperture. The first and second trigger aperture are spaced at a distance equal to a distance in between the first and second trigger sensor. The trigger signal is formed by a combination of the first and second sensor signal of the trigger sensors in which the presence of both the first and second trigger aperture are detected. When the first and second trigger sensor simultaneously detect the first and second trigger aperture of the beacon plate, the trigger signal is provided to readout the data of the beacon plate by the at least one read sensor.

The at least one read sensor is arranged to readout the data from the aperture pattern of the beacon plate. The at least one read sensor is configured for reading data from the beacon plate by detecting a presence or absence of a read aperture in the aperture pattern. The control unit is configured to receive the data signal from the at least one read sensor when the first and second trigger sensor provide the trigger signal.

A beacon plate may for example have a pattern of five read apertures in a row which are all open, and another beacon plate may for example have a pattern of five read apertures of which two are open/present and three are closed/absent. When readout by five read sensors, each of these beacon plates is adapted to provide a particular data signal, a specific code by generating corresponding sensor signals. Preferably, the trigger system comprises a plurality of distinguishing beacons. A use of such different beacon plates allow the trigger system to provide a specific data signal at a specific track position.

The rollercoaster according to the invention may provide at least one of the following advantages:

A major advantage is that the trigger system may provide a fast response. Because of the presence of the trigger sensors the operation of the rollercoaster trigger system according to the invention is like taking a picture instead of making a movie as in a scanning trigger system. In contrast to a trigger system which uses a scanning movement for reading a beacon plate and which needs multiple sample times to finally obtain the data signal, the trigger system according to the invention may perform a read-out of data within a single sample time. The first and second trigger sensor determine the moment of reading out the data of the beacon plate. Subsequently, the data can be read out in a single sample time, also called a single shot. Advantageously, the trigger system of the rollercoaster according to the invention may provide a fast response.

Another advantage is that the trigger system may have a negligible start-up time and interface with a digital IO. A bus system or a converter might be redundant for processing a data signal.

Advantageously, in comparison with a scanning trigger system, the trigger system according to the invention allows an application of smaller beacon plates in the rollercoaster. Passenger vehicles of a rollercoaster may move at high speeds. A train of passenger vehicles may for example move at a speed of 3 m/sec. A control unit may have a sample time of 2 msec which results in a travelled distance of 6 mm during that sample time. A corresponding measurement length of 6 mm on the beacon plate should be provided for reading out the data of the beacon plate. A trigger system based on a scanning movement necessitates more time to take a measurement which consequently results in a larger measurement length on a beacon plate. Thus, the trigger system according to the invention allows a use of relative small beacons, e.g. a beacon plate length of at most 200 mm.

Another advantage of the rollercoaster according to the invention may be that the signal data may include a variety of codes of information. Multiple read sensors can be used to readout for example 4-bit, 6-bit, 8-bit of information code. All read sensors are triggered by the first and second trigger sensor at the same time, such that the amount of read sensors does not affect a required readout time. Advantageously, complex data information can be readout in a single sample time. Complex data can be transferred in a fast response.

Another advantage of the rollercoaster according to the invention may be that the first and second trigger sensor of the trigger system may contribute in preventing erroneous measurements. A trigger to the at least one read sensor is only provided in case that both the side by side positioned first and second trigger sensor measure at the same time a presence of a trigger aperture. Each first and second trigger sensor may be configured as a simple binary sensor providing in operation a low or high sensor signal, i.e. a 0 or 1 signal. When the first and second trigger sensor are mounted to a passenger vehicle and an obstacle is detected, the obstacle will first be detected by the first trigger sensor and thereafter by the second trigger sensor. First, the first trigger sensor will switch from a high signal to a low signal, then the second trigger sensor will switch from the high signal to the low signal. The obstacle differs from a beacon plate and will not have two apertures which are equally spaced at a distance as the first and second trigger sensor, such that no simultaneously switch of both trigger sensors back to their high signal will occur. Thus, the obstacle will not render a trigger signal for a read-out by the at least one read sensor which contributes to a high level of reliability of the trigger system according to the invention.

Another advantage of the trigger system according to the invention may be that the trigger system reads out a same data signal independent of a travel direction. The trigger system according to the invention allows a single shot reading of the beacon plate in which it does not matter whether or not a passenger vehicle travels in a forward or backward direction at the predetermined track position. Herewith, independent of a travel direction, the rollercoaster trigger system according to the invention always reads out the same data from the beacon which may contribute in an increase in reliability.

The event to be carried out may be on board of the passenger vehicle or external from the passenger vehicle.

In an embodiment of the rollercoaster according to the invention, the event to be carried out is on board of the passenger vehicle. The control unit is positioned on board of the passenger vehicle to provide a control signal to carry out the event. The at least one sensor is mounted to the passenger vehicle and electrically connected to the control unit. The at least one sensor outputs the data signal to the on-board control unit. The beacon plate is positioned at the predetermined track position. Preferably, the beacon plate is fixed, preferably by welding, to the track of the rollercoaster.

In a particular embodiment, the event to be carried out may be a movement of the passenger seat relative to the chassis. In particular, the movement is a rotation in which the data signal includes information determining a rotation of the passenger seat. When receiving the data signal from the trigger system, the control unit controls a drive motor to carry out the movement of the passenger seat relative to the chassis. In particular the movement of the passenger seat is a rotational movement about a rotational axis. In particular, the data signal contains information regarding this rotational movement. Preferably, the data signal contains information regarding an angle of movement and/or an angular speed of movement. Advantageously, the trigger system provides an in time accurate and reliable data signal to control the movement of the passenger seat.

In an alternative embodiment of the rollercoaster according to the invention, the event to be carried out is external the passenger vehicle. The event to be carried out may be a start of a show element along the track, e.g. a start of a movie or a movement of a puppet along the track. The control unit for controlling the show element is arranged external from the passenger vehicle. In that embodiment, the beacon may be mounted to the passenger vehicle and the at least one sensor may be disposed at the predetermined track position. When receiving the data signal, the control unit outputs a control signal to start the show element, e.g. a start of a movie are a movement of a puppet. Herewith, the show element may respond in a specific manner depending of a presence of a particular passenger vehicle.

In an embodiment of the rollercoaster according to the invention, the at least one read aperture is positioned in between the first and second trigger aperture of the beacon plate. The first and second trigger aperture are formed by the first and last aperture of the aperture pattern.

In an embodiment of the rollercoaster according to the invention, all trigger and read apertures of the aperture pattern are positioned in a single row. The corresponding sensors for reading the apertures are aligned in the direction of travel. Preferably, each trigger and read aperture has a height of at least 2 cm. By placing all trigger and read apertures in an alignment in a single row, the beacon plate is configured optimal compact in height direction. The height of at least 2 cm may compensate for a change in a relative height of the passenger vehicle with respect to the track during its lifespan.

In an embodiment of the rollercoaster according to the invention when seen in the direction of travel, the at least one read aperture of the trigger system is sized larger than the trigger apertures. Preferably, a width of a read aperture is at least 20% larger than a width of a trigger aperture. Preferably, the aperture pattern of a beacon plate has a trigger aperture with a width of about 15 mm and at least one read aperture with a width of about 20 mm. Advantageously, at least one read sensor will switch earlier than the first and second trigger sensor which may contributes to a more reliable read-out of the predetermined data. Herewith, the trigger system may be independent of a switching time of a read sensor. By timely switching the at least one read sensor before the first and second trigger sensors, false readings may be prevented. The trigger system may be less vulnerable to electronic interferences.

In an embodiment of the rollercoaster according to the invention, the aperture pattern comprises at least three, in particular at least four, read apertures to be read by an equal amount of read sensors of the sensor set. Preferably, each open aperture is slot shaped. Advantageously, the amount of at least three apertures enables a collection of combinations of closed or open apertures. Preferably, a combination in which all read sensors are switched on or a combination in which all read sensors are switched off is excluded as a data signal for controlling the event. Preferably, these combinations are used for other purposes, e.g. for testing. Hence, four read apertures may result in a collection of 14 digital data signals. 14 values can be provided by the trigger system to let the control unit control the event.

In an embodiment of the rollercoaster according to the invention, the trigger system is configured to generate a so called awaiting trigger signal. The 'awaiting trigger signal' indicates that the trigger signal for a read-out of data is upcoming. Within a short timeframe, the trigger signal will be generated. The timeframe may for example be at most 1 second. The 'awaiting trigger signal' is generated after a switch of the second trigger sensor. The switch of the second trigger sensor may determine that the trigger signal is expected within the set timeframe of e.g. 1 sec. When no trigger signal occurs within this timeframe in which both the first trigger sensor and the second trigger sensor switch by sensing and aperture, the control unit may be programmed to ignore received signals for a set time interval. Preferably, the 'awaiting trigger signal' is provided when the beacon plate of the trigger system meets the sensors set, wherein the first trigger sensor passes along the beacon and wherein the second trigger sensor meets a front edge of the beacon plate. Advantageously, a control based on the awaiting trigger signal may reduce an amount of force readings.

Further, the invention relates to a rollercoaster trigger system as defined in claim 10

Further, the invention relates to a method for controlling an event by using a rollercoaster trigger system as defined in claim 12.

In an aspect of the invention, the invention relates to a rollercoaster and a rollercoaster trigger system to output a data signal to a control unit for triggering and controlling an event, wherein the trigger system comprises a beacon cooperating with at least one sensor, in which one of the beacon and the at least one sensor is positionable at a predetermined track position and the other is mountable to a passenger vehicle of the rollercoaster, wherein the beacon is formed by a beacon plate which includes an aperture pattern of present or absent apertures which aperture pattern represents the predetermined data to be read by the at least one sensor, and wherein the at least one sensor of the trigger system comprises a sensor set disposed in correspondence with the aperture pattern to allow sending a trigger signal and a data signal out of a variety of possible data signals to the control unit, wherein the sensor set comprises at least one of a first and a second trigger sensor, which trigger sensor provide a trigger signal to readout the data from the aperture pattern when the at least one of the first and second trigger sensor detect at least one of a first and second trigger aperture of the aperture pattern, and at least one read sensor for reading the data by detecting a presence or absence of at least one read aperture of the aperture pattern, wherein the control unit is configured to obtain the data signal from the at least one read sensor when the at least one of the first and second trigger sensor provides the trigger signal.

In an embodiment, the sensor set of the trigger system comprises both a first and a second trigger sensor. Preferably, the first and second trigger sensor are seen in a travel direction positioned behind each other to prevent false trigger signals. Alternatively, the first and second trigger sensor may be arranged above each other.

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims, in which:

Figure 1:
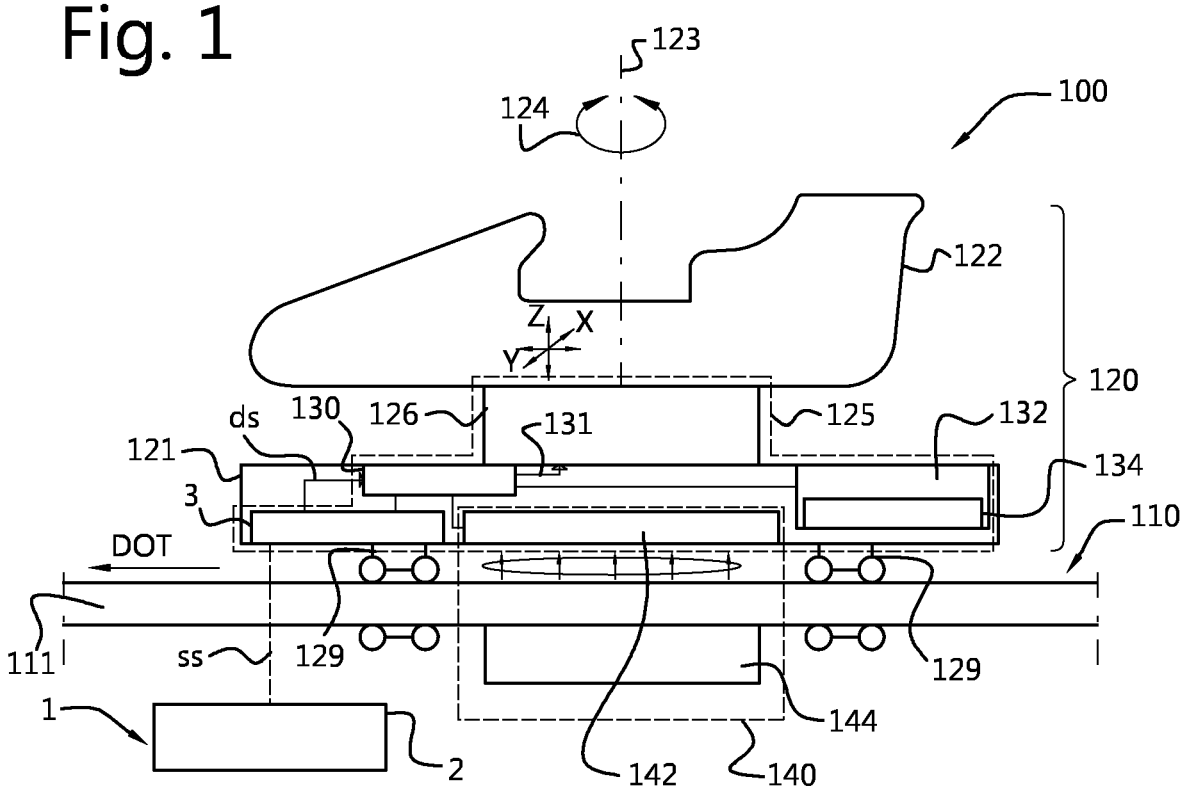
FIG. 1 shows a schematic side view of a rollercoaster comprising a vehicle on a track which rollercoaster is provided with an on-board control unit with a trigger system having a sensor for sensing a beacon.

Identical reference signs are used in the drawings to indicate identical or functionally similar components.

Figure 2:
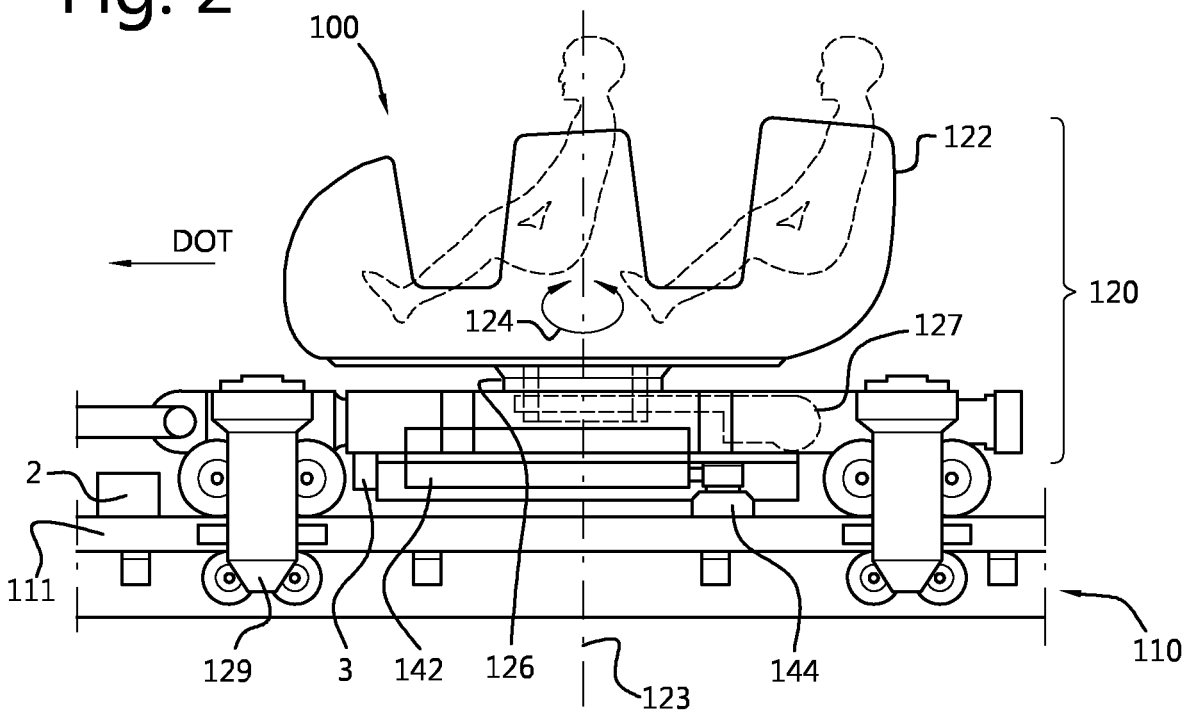
FIG. 2 shows a side view of a rollercoaster with a rotatable passenger seat to be controlled by the trigger system.
Figure 3:
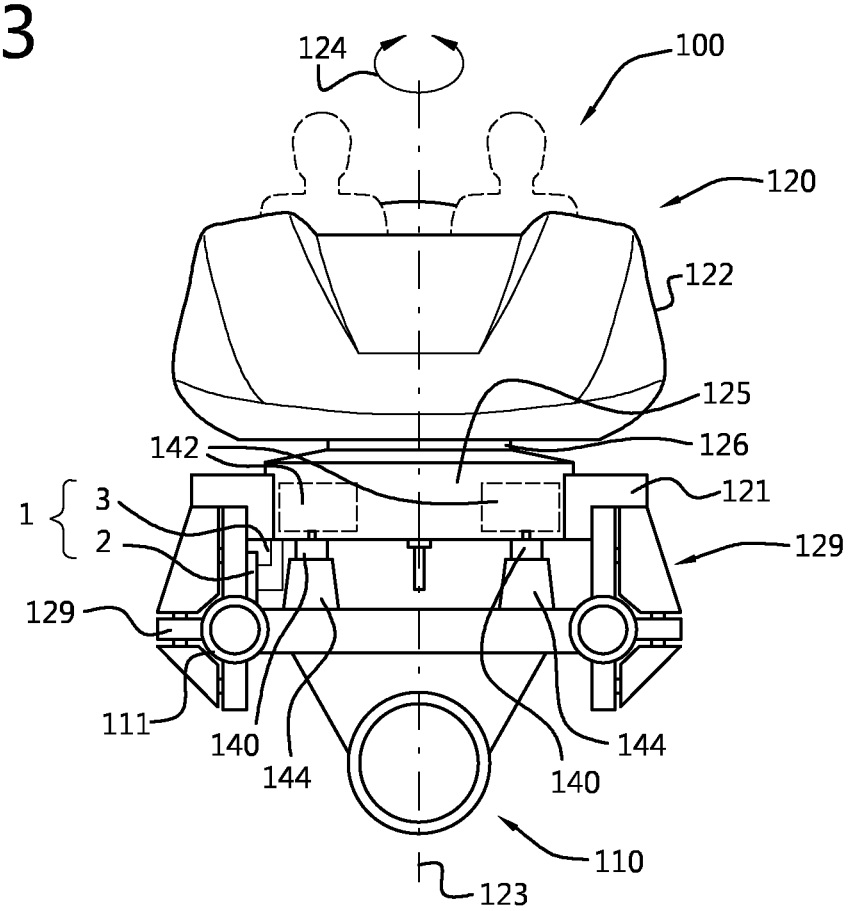
FIG. 3 shows a frontal view of a rollercoaster in a passenger seat is rotatable relative to a chassis of the vehicle.

FIG. 1-3 show a rollercoaster which is configured to provide a ride experience to its passengers. The rollercoaster comprises a track 110 with a rail 111 to support a passenger vehicle 120. Typically, a rollercoaster 100 would include a plurality of such vehicles 120 in which the vehicles are coupled to each other into a train of vehicles. The track 110 defines a direction of travel DOT, also called a travel direction, of the passenger vehicle 120. The track may comprise loops, screws or fall downs to increase the excitement of the ride in which the passenger vehicle travels in different orientations with respect to gravity.

The passenger vehicle 120 has a chassis 121 and at least one passenger seat 122. The chassis 121 comprises a wheel assembly for mounting the chassis 121 to the rail 111 of the track 110.

The passenger seat 122 is movable in rotation with respect to the chassis 121. The passenger seat 122 is rotatable about a pivot axis 123 to carry out a yaw movement 124 as shown by an arrow. The axis of rotation 123 may—when seen in a passenger entry/exit position—extend vertically through the centre of gravity of the passenger seat 122 or be the vehicles vertical axis.

The passenger vehicle 120 has a control system 125 which includes a control unit 130. The control unit is mounted to the passenger vehicle 120, a so called on-board control unit 130. The control unit 130 is operable connected to a positioning system 126 for positioning the passenger seat 122 with respect to the chassis 121.

For example, the control unit 130 may operate to implement a programmable yaw movement (or other motion profile) to place the passenger seat 122 from an initial or first position with the passenger seat 122 and its passengers facing forward along the direction of travel DOT defined by the track 110 to a second position with the passenger seat and its passengers facing a direction differing from the direction of travel DOT such as due to the yaw movement defined by the motion profile.

For example, a yaw movement may be provided as shown with the arrow 124 about the axis of rotation 123 of the passenger seat 122 to orient the passenger seat 122 to the left of right of the travel direction DOT at an angle in the range of 15° to 90° or more such as to cause the passengers to view a visual display or the like along a particular section of the track 110. In an embodiment, the motion of the passenger seat 122 from the initial position may be along any of the X, Y and/or Z axis as shown in FIG. 1. The yaw movement 124 may be programmable such as via the use of a motion profile 134 which is to be run by the control system 125.

For example, any movement may be provided along a degree of freedom other than the vehicles motion along the travel direction DOT. Herewith, during operations, the passenger seat 122 is positionable in one or more positions or orientations with respect to the chassis 121, such that the passenger seat 122 faces a direction that is at an angle to the travel direction DOT.

The positioning system 126 comprises a seat motor 127 for moving the passenger seat 122 with respect to the chassis 121. Here, the seat motor 127 is an electrical drive which is mounted to the chassis 121. The drive is coupled by a gearbox and a linkage assembly to the passenger seat 122 to drive the passenger seat 122 in rotation.

The control system 125 further comprises a number of chassis-mounted components to selectively power and operate the positioning system 126 of the passenger seat 122. The control unit 130 is mounted to the chassis 121. The control unit 130 is provided with a memory 132 for storing a motion profile 134. In operation, the control unit 130 generates a control signal 131 to the positioning system 126 to operate the passenger seat 122 and to provide the motion as programmed in the motion profile 134.

To provide power to the control system 125, the rollercoaster 100 includes a power supply 140. The power supply 140 may comprise an on-board energy storage 142 which is mounted to the chassis 121 and/or a track-based power source 144. The control unit 130 can selectively use the energy storage 142 to power any operations on board of the passenger vehicle even when the passenger vehicle is spaced apart from any track-based power source 144. The track-based power source 144 is arranged to provide electrical power to the passenger vehicle. The track-based power source 144 may be used to charge the on-board energy storage 142. The track-based power source 144 may be provided in any form, such as with a capacitor charge plate, a bus bar charging strip or the like.

The control unit 130 is operable connected to a trigger system 1. The trigger system is configured to output a data signal 'ds' to the control unit 130 to carry out an event at a predetermined track position. The data signal 'ds' may contain for example data defining in which direction, to what magnitude and at which angular speed a motion of the passenger seat 122 should be carried out. As shown in FIG. 1-3, the trigger system 1 outputs the data signal 'ds' to the control unit 130 to carry out a predetermined movement of the passenger seat 122 at the predetermined track position. In another embodiment, the trigger system 1 may be used to trigger another event, e.g. a start of a show element in a neighbourhood of the vehicle 120.

The trigger system 1 comprises a beacon 2 which cooperates with at least one sensor 3. The beacon 2 is arranged to contain data which is readable by the at least one sensor 3. As shown in FIG. 1-3, the beacon 2 has a fixed position at the track 110. The beacon 2 is positioned at a predetermined track position. Preferably, the beacon is fixed to the track 110.

The beacon 2 contains data D which is specific for the predetermined track position. The at least one sensor 3 comprises a sensor set 30 which is configured to obtain this predetermined data D from the beacon 2. The sensor set is mounted to the passenger vehicle 120. In a rollercoaster ride, the sensor set travels together with the passenger vehicle 120 and passes along at least one beacon 2. When the sensor set 30 meets the beacon 2, the data D is read out by the sensor set 30.

The reading of the beacon 2 by the sensor set 30 is carried out by a particular method. In this method, a trigger signal 'ts' is awaited for capturing a data signal 'ds' by the control unit 130.

The control unit 130 of the control system 125 is configured to receive the trigger signal 'ts' and the data signal 'ds' from the trigger system 1. The trigger signal 'ts' determines a moment for obtaining the data signal 'ds' by the control unit 130. The data signal 'ds' represents the data D related to the predetermined track position of the passenger vehicle 120.

FIG. 4-9 show in schematic views successive steps of a method for reading out data from a beacon 2 by a plurality of sensors 3 forming the sensor set 30. The beacon 2 is mountable to a track 110 and the sensor set 30 is mountable to a vehicle 120. The arrow indicates a direction of travel DOT of the sensors set 30 travelling with the vehicle 120.

The beacon 2 is formed by a beacon plate 20. The beacon plate 20 is a metal plate. The beacon plate 20 is elongated and has a rectangular shape. The beacon plate 20 may have a height of about 50 mm and a length of about 180 mm.

The beacon plate 20 comprises an aperture pattern 21. The aperture pattern 21 contains linearly spaced apertures. The apertures are aligned. Preferably, the apertures are spaced at a regular interval. Seen in the direction of travel DOT, the apertures are positioned behind each other. The apertures are positioned in correspondence with a positioning of the sensors of the sensor set 30. The aperture pattern contains an array of open/closed apertures. Each aperture may be open or closed, which open or closed aperture of the pattern represents a particular piece of data to be read by the sensor set 30.

Figures 9, 10:
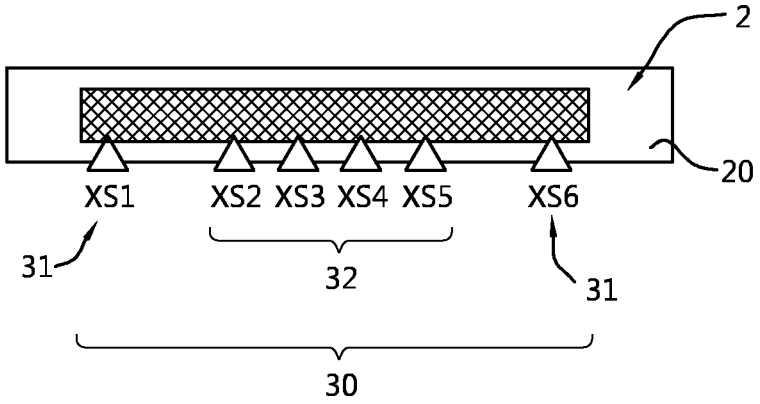
FIG. 10 shows a table containing data values which are readable by the trigger system.

FIG. 10 shows a table containing different values of data which can be read by the trigger system 1 when using four apertures 'ra' in the aperture pattern 21 and four read sensors 321,322,323,324. A specific combination of open and closed apertures represents the predetermined data D readable by the sensor set 30. Here in FIG. 10, the data D is formed by a combination of four open/closed apertures. Four read sensors xs2, xs3, xs4, xs5 are provided to read out this aperture pattern. When all apertures of the aperture pattern are closed, a value 0 is read out, and when all apertures of the aperture pattern are open, a value 15 is read out. Other values can be read out in combinations in which some of the apertures are open while other apertures are closed.

Figure 4:
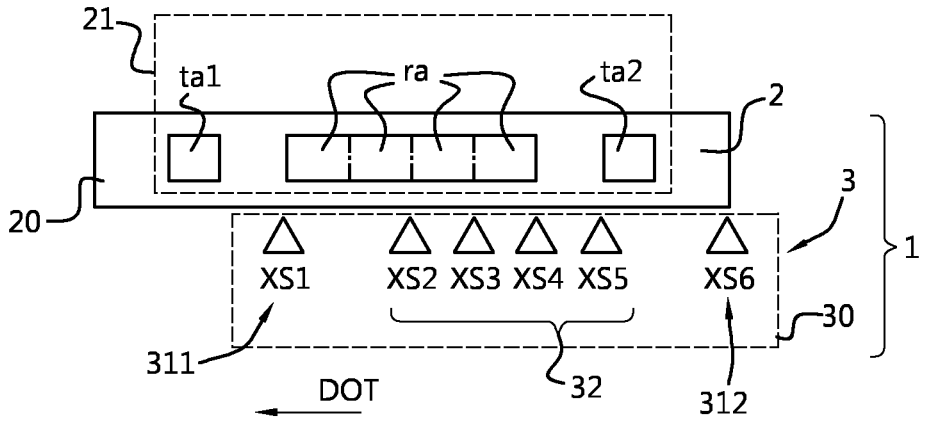
FIG. 4 shows a schematic view of the trigger system according to the invention, wherein a second trigger sensor meets a front edge of a beacon plate.

FIG. 4 shows a plurality of sensors 3 which comprises a sensor set 30 which sensors are indicated with xs1, xs2, xs3, xs4, xs5, xs6. All sensors may be of the same type. Preferably, the sensors are optical sensors. Preferably, each sensor of the sensor set is a binary sensor. In operation, each sensor may switch between a flow and high sensor signal. The sensors are disposed in correspondence with the aperture pattern 21 of the beacon 2. Each sensor of the sensor set is positioned for reading out one of the open/closed aperture of the aperture pattern 21. Each sensor of the sensor set provides a sensor signal which may be a high or low signal which corresponds respectively with a closed and open aperture. Each sensor of the sensor set is configured to read out whether or not an aperture of the aperture pattern 21 is open/present or closed/absent.

As said above, in use of the trigger system 1, a trigger signal 'ts' is awaited for capturing a data signal 'ds' by the control unit 130. The trigger signal 'ts' determines a moment of reading out the aperture pattern 21 by at least one read sensor 32. At the moment of the trigger signal 'ts', a combination of sensor signals 'ss' from the sensor set 30 corresponds with the predetermined data D represented by the aperture pattern 21 of the beacon 2.

The shown sensor set 30 is arranged to send a trigger signal 'ts' and a data signal 'ds' out of the variety of possible data signals to the control unit 130 as illustrated in FIG. 10.

The sensor set 30 comprises a trigger sensor subset 31. The sensor set 30 comprises a first and a second trigger sensor 311, 312; xs1, xs6 which are seen in the travel direction DOT disposed behind each other. The trigger sensors xs1,xs6 together provide the trigger signal 'ts' which represents a moment for reading out the data D of the beacon plate 20. The moment is determined when the first and second trigger sensor together simultaneously detecting a first and second trigger aperture 'ta1, ta2' of the beacon plate 20.

Further, the sensor set 30 comprises a read sensor subset 32. The sensor set 30 comprises a plurality of read sensors 321,322,323,324; xs2, xs3, xs4, xs5 for reading data D from the beacon plate 20 by detecting a presence or absence of at least one read aperture 'ra' in accordance with FIG. 10. Here, the read sensors xs2-xs5 are positioned in between the first and second trigger sensor xs1 and xs6. The control unit 130 is configured to obtain the data signal 'ds' from the at least one read sensor xs2, xs3, xs4, xs5 when the first and second trigger sensor xs1, xs6 provide the trigger signal 'ts'.

FIG. 4 shows a situation in which the sensor set 30 formed by the array of sensors xs1-xs6 is moving along the aperture pattern 21 of the beacon 2. The array of sensors xs1-xs6 is overlapping the beacon plate 20. The first trigger sensor 311 has passed several apertures of the aperture pattern 21. The first trigger sensor 311 has switched several times from a high signal to a low signal when passing the apertures. The second trigger sensor 312 at the end of the array of sensors has just reached the beacon plate 20. The second trigger sensor 312 is positioned at a front edge of the beacon plate 20 and is sensing a presence of the plate. The second trigger sensor 312 switches for a first time from a high signal to a low signal.

Figure 5:
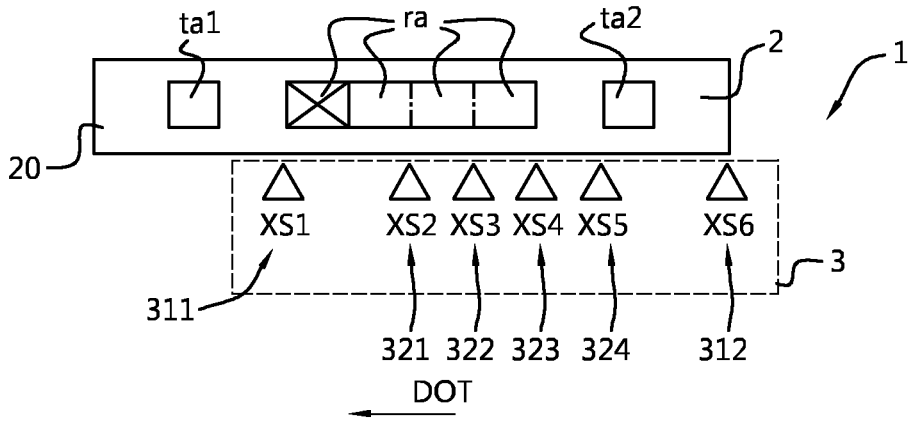
FIG. 5 shows a beacon plate having an aperture pattern including one closed read aperture and three open read apertures.

FIG. 5 shows the moment in which a trigger signal 'ts' is provided. The trigger signal 'ts' will be generated when both the first and second trigger sensors 311, 312 reach respectively a first trigger aperture ta1 and a second trigger aperture ta2. At this moment, both the first and second trigger sensor 311, 312 switch at the same time to a high signal. This moment is recognised as the trigger signal 'ts'.

The trigger system 1 is operatively connected to the control unit 130 to provide the data signal 'ds' at the moment of the trigger signal 'ts'. The data signal 'ds' is formed by at least one sensor signal 'ss' provided by the read sensors 321, 322, 323, 324. In FIG. 5, the first read sensor 324 senses a closed (or absent) aperture, while the second, third and fourth read sensor 322, 323, 324 sense an open (or present) aperture of the aperture pattern 21. In comparison with the table of FIG. 10, this data signal here represents a value 8 to be interpreted by the control unit 130. Based on this received value 8, the control unit may operate the passenger seat 122 in a particular way, e.g. by rotating the seat about 30° in 5 seconds.

Figure 6:
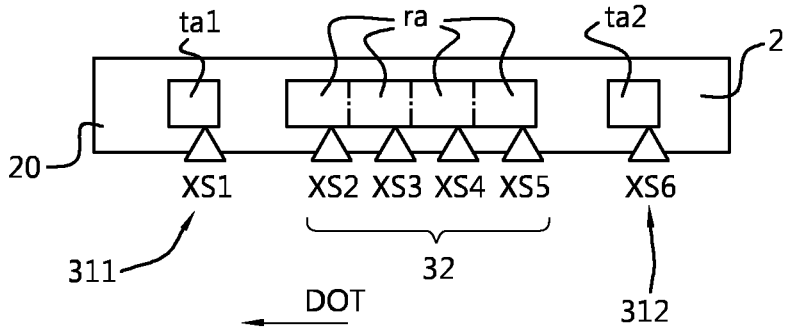
FIG. 6 shows the trigger system, wherein the trigger apertures are larger than the read apertures.

FIG. 6 shows a preferred dimensioning of the apertures of the aperture pattern 21. As shown, the read apertures 'ra' are sized larger than the trigger apertures 'ta1, ta2'. The width of the trigger apertures is smaller than the width of the read apertures. A centre line of each aperture is positioned in correspondence with a centre line of an accompanying sensor of the sensor set. The sensors of the sensor said are positioned at a pitch length in correspondence with a pitch length in between the apertures of the aperture pattern 21. Preferably, the read sensors 32 are spaced at a constant pitch length, and the accompanying read apertures are spaced at the same constant pitch length. Preferably, the trigger sensors 31 are spaced at a pitch length which equals a pitch length in between the trigger apertures 311, 312. Seen in the direction of travel DOT, the at least one read aperture 'ra' is sized larger than the trigger apertures ta1, ta2. As a consequence of this difference in size, the read sensors 32 will switch earlier than the trigger sensors 31. This is illustrated in FIG. 6, in which the trigger sensors 311, 312 are positioned at an edge of the trigger apertures, while the read sensors 32 have already moved somewhat away from an edge of the read apertures. Advantageously, a read-out of the predetermined data has become more reliable in that the read-out is not dependent on tolerances in the positioning of an edge of a read aperture.

Figure 7:
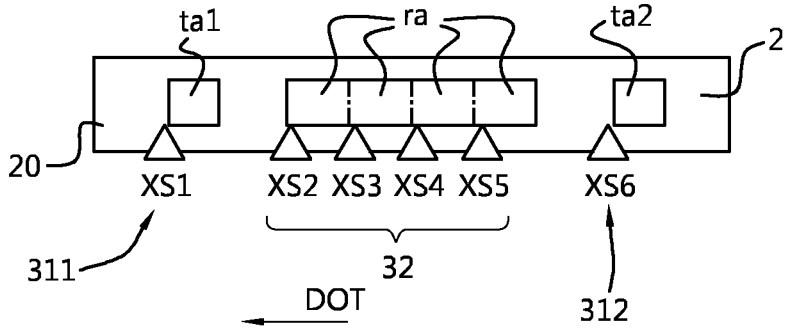
FIG. 7 show the trigger system, wherein the trigger sensors switch before a switch of the the read sensors.

FIG. 7 shows the sensor set 30 running along the beacon plate, wherein the first and second trigger sensor 311, 312 switch when quitting the trigger apertures ta1, ta2. The first and second trigger sensor 311, 312 switch before a switch of the read sensors 32. Analogous to the situation as shown in FIG. 6, this separate switching contributes in a more reliable read-out of the predetermined data of the aperture pattern 21. A false reading may be prevented by first switching off the first and second trigger sensor 311, 312.

Figure 8:
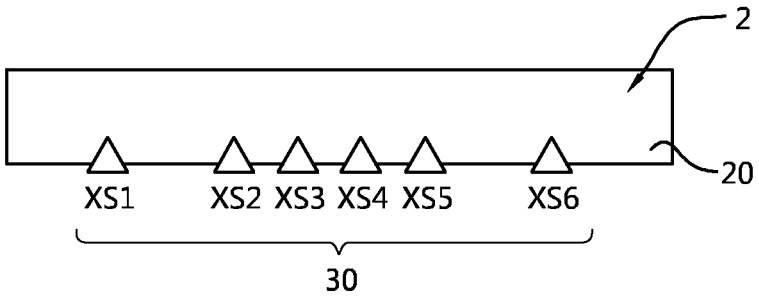
FIGS. 8 and 9 show a test-beacon plate of the trigger system.

FIG. 8 and FIG. 9 show a test-beacon 2 in which the aperture pattern 21 is fully closed or provided with a mesh. All possible apertures of the aperture pattern 21 are at least partly closed. When the sensor set 30 runs along the test-beacon plate 20, all sensors 31, 32 will switch one time. Each sensor will provide a same pulse when running at a constant speed along the beacon plate 21. When running along the closed beacon plate of FIG. 8, all sensors will switch between a high and low signal, while running along the meshed beacon plate of FIG. 9, all sensors will switch between a high/low and intermediate signal. The control unit 130 may be programmed to receive such a signal from the sensor set in a test protocol to check whether or not all sensors 30 operate correctly. Herewith, the beacon plate 21 is suitable to be used to carry out a sensor test. If any sensor does not respond as expected, e.g. a signal difference is too small, the sensor may be identified by the control unit 134 for a cleaning operation.

Numerous variants are possible in addition to the embodiment shown in the figures. In a variant of the illustrated embodiment of the rollercoaster, the trigger system may be used to control an event external the vehicle, e.g. to control a movement of a puppet. The control unit may be connected to the trigger system and positioned stationary aside the track. The trigger system may include a vehicle mounted beacon and a stationary sensor set.

Although the present invention has been described in detail, it will be apparent to those skilled in the art that various changes and modifications can be made without departing from the scope of the invention as hereinafter claimed. It is intended that all such changes and modifications be encompassed within the scope of the present disclosure and claims.

Thus, the invention provides a rollercoaster, rollercoaster trigger system and method to output a data signal to a control unit for triggering and controlling an event at a predetermined track position. A beacon plate with a certain aperture pattern and a sensor set is provided to send a trigger signal and a data signal to the control unit. The sensor set comprises a first and a second trigger sensor which provide together the trigger signal to readout the data of the beacon plate when together simultaneously detecting a first and second trigger aperture of the aperture pattern. A read sensor is provided for reading data from the aperture pattern by detecting a presence or absence of a read aperture. The data signal is obtained by the control unit when the trigger signal is generated.

REFERENCE LIST

100 rollercoaster
110 track
111 rail
112 bus bar
120 passenger vehicle
121 chassis
129 wheel assembly
122 passenger seat
123 pivot axis; axis of rotation
124 yaw movement
125 control system
126 positioning system
127 seat motor
130 on-board control unit
131 initiate/control signal
132 memory
134 motion profile
140 power supply
142 on-board energy storage
144 power source
DOT direction of travel; travel direction
1 trigger system
2 beacon; beacon plate
20 beacon plate
21 aperture pattern
ds data signal
ss sensor signal
ta trigger aperture
ta1 first trigger aperture
ta2 second trigger aperture
ra read aperture
ts trigger signal
3 at least one sensor
30 sensor set
ss sensor signal
31 trigger sensor subset
311 first trigger sensor
312 second trigger sensor
32 read sensor subset
321 first read sensor
xs1 . . . xs6 array of sensors
xs1 first trigger sensor
xs6 second trigger sensor
xs2 first read sensor
xs3 second read sensor
xs4 third read sensor
xs5 fourth read sensor

The invention claimed is:

1. A rollercoaster comprising:

a track with a rail to provide a rollercoaster ride path;

at least one passenger vehicle mounted to the rail to travel the passenger vehicle in a travel direction along the rollercoaster ride path, in which the passenger vehicle comprises at least one passenger seat mounted on a chassis; and a trigger system to output a data signal to a control unit to carry out an event, in which the trigger system comprises a beacon cooperating with at least one sensor, in which one of the beacon and the at least one sensor is positioned at a predetermined track position and the other is mounted to the passenger vehicle, wherein the beacon is formed by a beacon plate which includes an aperture pattern of present or absent apertures, the aperture pattern representing predetermined data to be read by the at least one sensor, wherein the at least one sensor of the trigger system comprises a sensor set disposed in correspondence with the aperture pattern to allow sending a trigger signal and a data signal out of a variety of possible data signals to the control unit, wherein the sensor set comprises:

a first and a second trigger sensor which are seen in the travel direction disposed behind each other, the trigger sensors providing together the trigger signal to readout the data from the aperture pattern when the first and second trigger sensor together simultaneously detect a first and second trigger aperture of the aperture pattern; and at least one read sensor for reading the data by detecting a presence or absence of at least one read aperture of the aperture pattern, and wherein the control unit is configured to obtain the data signal from the at least one read sensor when the first and second trigger sensor provide the trigger signal.

2. The rollercoaster according to claim 1, wherein the event to be carried out is on board of the passenger vehicle, wherein the beacon plate of the trigger system is positioned at the predetermined track position and the sensor set is mounted to the passenger vehicle, and wherein the sensor set is connected to an on-board control unit which is configured to output a control signal to carry out the event.

3. The rollercoaster according to claim 2, wherein the event to be carried out is a movement of the passenger seat relative to the chassis of the passenger vehicle, and wherein in particular the data signal contains information regarding a rotational movement more in particular regarding an angle of movement and/or an angular speed of movement.

4. The rollercoaster according to claim 3, wherein the at least one read aperture is positioned in between the first and second trigger aperture of the beacon plate.

5. The rollercoaster according to claim 3, wherein all trigger and read apertures of the aperture pattern are positioned in a single row.

6. The rollercoaster according to claim 3, wherein all the trigger and read apertures have a height of at least 2 cm.

7. The rollercoaster according to claim 2, wherein the at least one read aperture is positioned in between the first and second trigger aperture of the beacon plate.

8. The rollercoaster according to claim 2, wherein all trigger and read apertures of the aperture pattern are positioned in a single row.

9. The rollercoaster according to claim 2, wherein all the trigger and read apertures have a height of at least 2 cm.

10. The rollercoaster according to claim 1, wherein the at least one read aperture is positioned in between the first and second trigger aperture of the beacon plate.

11. The rollercoaster according to claim 10, wherein all trigger and read apertures of the aperture pattern are positioned in a single row.

12. The rollercoaster according to claim 10, wherein all the trigger and read apertures have a height of at least 2 cm.

13. The rollercoaster according to claim 1, wherein all trigger and read apertures of the aperture pattern are positioned in a single row.

14. The rollercoaster according to claim 1, wherein all the trigger and read apertures have a height of at least 2 cm.

15. The rollercoaster according to claim 1, wherein seen in the direction of travel, the at least one read aperture is sized larger than the trigger apertures.

16. The rollercoaster according to claim 1, wherein the aperture pattern comprises at least three, in particular at least four, read apertures and an equal amount of read sensors of the sensor set.

17. The rollercoaster according to claim 1, wherein the control unit is programmed to control the event only after first receiving an 'awaiting trigger signal' formed by a signal switch of the second trigger sensor and subsequently the trigger signal within a predetermined time interval starting from the awaiting trigger signal.

18. A rollercoaster trigger system to output a data signal to a control unit for triggering and controlling an event, wherein the trigger system comprises:

a beacon cooperating with at least one sensor, in which one of the beacon and the at least one sensor is positionable at a predetermined track position and the other is mountable to a passenger vehicle of the rollercoaster, wherein the beacon is formed by a beacon plate which includes an aperture pattern of present or absent apertures, the aperture pattern representing predetermined data to be read by the at least one sensor;

wherein the at least one sensor of the trigger system comprises a sensor set disposed in correspondence with the aperture pattern to allow sending a trigger signal and a data signal out of a variety of possible data signals to the control unit, wherein the sensor set comprises:

a first and a second trigger sensor which are seen in the travel direction disposed behind each other, the trigger sensors providing together the trigger signal to readout the data from the aperture pattern when the first and second trigger sensor together simultaneously detect a first and second trigger aperture of the aperture pattern; and at least one read sensor for reading the data by detecting a presence or absence of at least one read aperture of the aperture pattern, and wherein the control unit is configured to obtain the data signal from the at least one read sensor when the first and second trigger sensor provide the trigger signal.

19. The rollercoaster trigger system according to claim 18, wherein the rollercoaster trigger system comprises a set of plate shaped beacons having each a distinguishing aperture pattern which each represents specific data.

20. A method for controlling an event at a predetermined track position of a rollercoaster, in which the event is in particular a movement of a passenger seat of a passenger vehicle during operation of a rollercoaster ride, comprising steps of:

providing the rollercoaster trigger system according to claim 18;

providing a trigger signal by a first and second trigger sensor of the trigger system for reading out data from a beacon at the predetermined track position;

reading data from the beacon by at least one read sensor of the trigger system; and obtaining a data signal by the control unit of the roller-coaster at the moment of receiving the trigger signal for controlling the event.

* * * * *